US005353021A

United States Patent [19]

Toyama

[11] Patent Number: 5,353,021

[45] Date of Patent: Oct. 4, 1994

[54] APPARATUS FOR MEASURING MOVING STATE OF VEHICLE IN TUNNEL

[75] Inventor: Masakazu Toyama, Tokyo, Japan

[73] Assignee: Matsushita Electric Industrial Co., Ltd., Osaka, Japan

[21] Appl. No.: 935,283

[22] Filed: Aug. 26, 1992

[30] Foreign Application Priority Data

Sep. 4, 1991 [JP] Japan ..... 3-250277

[51] Int. Cl.[5] ..... G08G 1/017

[52] U.S. Cl. ..... 340/937; 340/933

[58] Field of Search ..... 340/937, 933, 936; 382/50

[56] References Cited

FOREIGN PATENT DOCUMENTS 3115613 11/1982 Fed. Rep. of Germany .
2110695 4/1990 Japan .
0211600 8/1990 Japan .
2306399 12/1990 Japan .
0179598 8/1991 Japan .
0192499 8/1991 Japan .

*Primary Examiner*—Jeffery A. Hofsass
*Attorney, Agent, or Firm*—Stevens, Davis, Miller & Mosher

[57] ABSTRACT

An apparatus for measuring a moving state of a vehicle in a tunnel, in which traffic information such as number of vehicles which have passed, velocity, and the like can be always accurately measured without being influenced by changes in brightness in the tunnel. The measuring apparatus has an image pickup device installed in the tunnel and an image processing device for processing image data generated from the image pickup device. The apparatus further includes an input device for receiving a brightness/darkness signal which is changeable to adjust brightness of an illuminating apparatus installed in the tunnel, and adjusting device for adjusting an operation of the image pickup device or an operation of the image processing device in accordance with a change of the brightness/darkness signal, thereby preventing possible errors caused in the measurement.

6 Claims, 9 Drawing Sheets

APPARATUS FOR MEASURING MOVING STATE OF VEHICLE IN TUNNEL

BACKGROUND OF THE INVENTION

This invention relates to an apparatus for measuring a moving state of a vehicle in a tunnel, in which by processing an image output signal from an image pickup camera installed in the tunnel, necessary traffic information such as velocity of a vehicle, the number of vehicles which have passed, distinction between a large vehicle and a small vehicle, and the like is measured and collected.

A conventional apparatus for measuring a moving state of vehicle or automobile in a tunnel is constructed in a manner such that original image data obtained by photographing a moving state of a vehicle in the tunnel and background data are image-processed to measure vehicle velocity, number of vehicles which have passed, kinds of vehicles (distinction between small car and large car), and the like, and the measured results are output.

In the above apparatus, the moving state of a vehicle is measured by a procedure shown in FIGS. 9A and 9B. FIG. 9A shows the conventional apparatus, while FIG. 9B illustrates the signal waveforms corresponding to each element of FIG. 9A.

A moving state of vehicle in a tunnel is photographed by a video camera 1 and a video analog signal is converted into digital data by an A/D converting section 2. The digital data i of one frame which has been converted by the A/D converting section 2 is stored into an image memory 3 together with background data ii previously stored as an image in the tunnel in a state in which no vehicle exists.

In an image processing section 4, data of the vehicle portion is extracted by a differential process (i–ii) between the digital data i and ii. By determining a portion of the data exceeding a threshold value, the front edge portion of the vehicle is detected.

The data of the front edge portion is sent to a data processing section 5. The data processing section 5 compares transmitted present data iii and previous data iv of the front edge portion which has been detected from the image before a predetermined time, thereby measuring the vehicle velocity, the number of vehicles passed, and the like. In these technical fields, for example, JP-A-2-306399 shows techniques for imaging or recording running vehicles by a TV camera, and JP-A-2-110695 shows a traffic control system for informing of escape directions upon occurrence of emergency states in a tunnel.

However, an illuminating apparatus in the tunnel has its illumination brightness changed between a few patterns in accordance with a brightness/darkness signal from a central unit, in order to reduce a difference between the brightness tunnel and the brightness in the outside the tunnel. In such a conventional apparatus for measuring a moving state of a vehicle in the tunnel, the video signal which is transmitted from the video camera changes at a time point at which the brightness in the tunnel is switched, so that differential data between the front edge data and the background data also changes and there is a possibility such that an error occurs in the data of the detected front edge portion. Therefore, the conventional apparatus for measuring the moving state of vehicle in the tunnel has a problem such that a measuring rate or capability of the traffic information deteriorates for a period of time which is taken until the measuring apparatus follows changes in brightness.

SUMMARY OF THE INVENTION

The present invention intends to solve such conventional problems and it is an object of the invention to provide an apparatus for measuring a moving state of a vehicle in a tunnel, in which traffic information such as number of vehicles, velocity, and the like can be accurately measured without being influenced by changes in brightness of the illuminating apparatus in the tunnel.

According to the invention, therefore, there is provided an apparatus for measuring a moving state of a vehicle in a tunnel having image pickup means installed in the tunnel and image processing means for processing image data that is transmitted from the image pickup means, wherein the apparatus comprises input means for receiving a brightness/darkness signal to adjust the brightness of an illuminating apparatus installed in the tunnel, and adjusting means for adjusting the image pickup means or the image processing means in accordance with the received brightness/darkness signal.

As the above adjusting means, there is provided means for adjusting a "diaphragm" of the image pickup means or means for adjusting a "threshold level for analog/digital conversion", a "threshold value" for detection of vehicle front edge portion, or "background data which is used for image processing" of the image processing means.

Therefore, even in the case where the brightness in the tunnel changes in response to a change in brightness/darkness signal, the adjusting means of the image pickup means or the image processing means of the measuring apparatus of the moving state of a vehicle in the tunnel is operated to effect the adjustment so as not to cause an error in the result of the measurement.

DESCRIPTION OF THE PREFERRED EMBODIMENTS

First embodiment

In an apparatus of the first embodiment, a diaphragm of a video camera as image pickup means is adjusted in accordance with a brightness/darkness signal to change the brightness of an illuminating apparatus in the tunnel.

Figure 1:
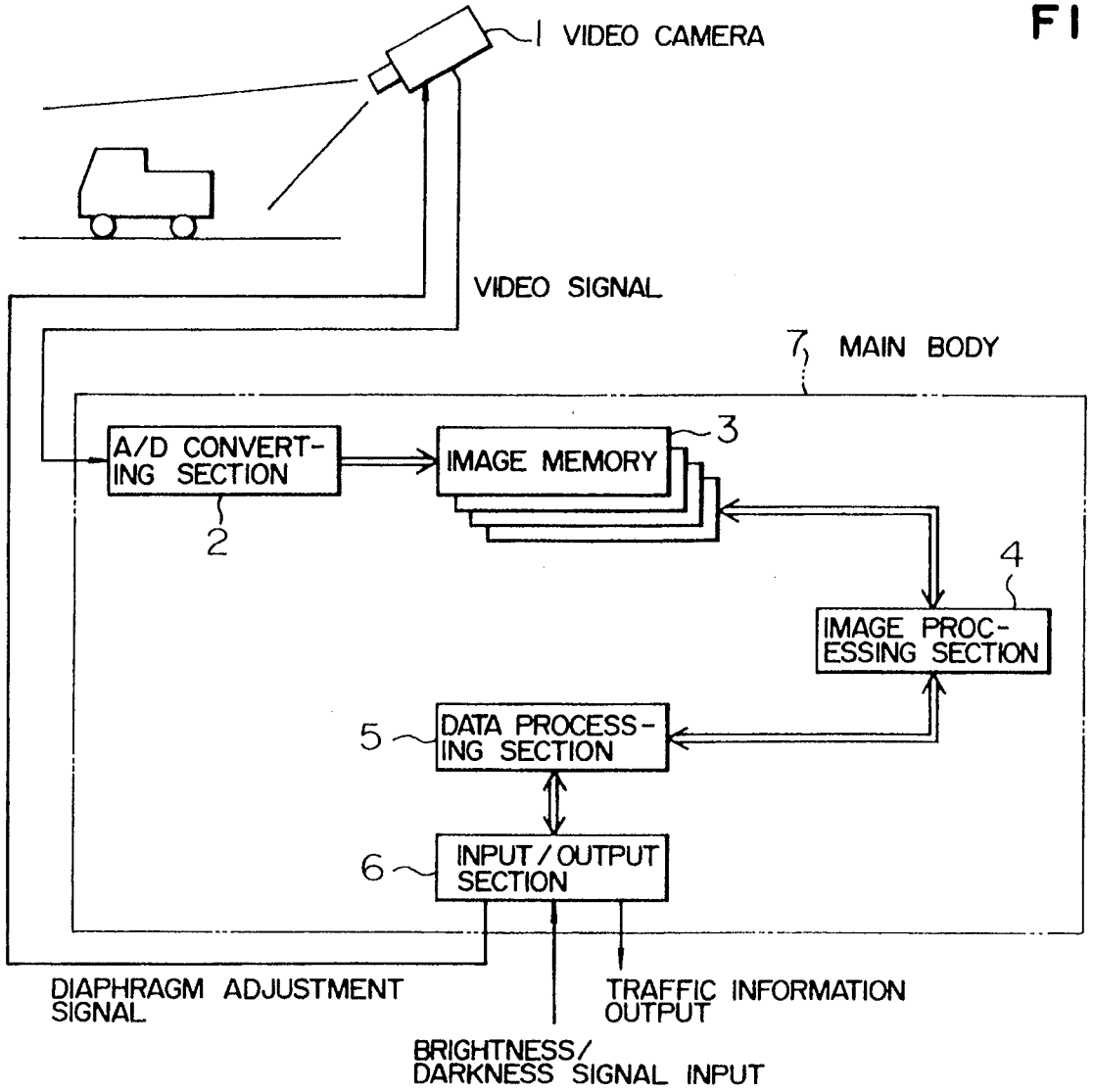
FIG. 1 is a block diagram of an apparatus for measuring a moving state of a vehicle in a tunnel according to the first embodiment.

As shown in FIG. 1, the apparatus of the first embodiment comprises the video camera 1 installed at a position to look down on the road in the tunnel in order to photograph a moving state of a vehicle and a main body 7 of an apparatus for measuring a moving state of a vehicle in the tunnel as image processing means. The measuring apparatus main body 7 of the moving state of the vehicle in the tunnel comprises: the A/D converting section 2 to convert the video analog signal into digital data; the image memory 3 to store the digital data of the photographed image and the background data; the image processing section 4 to process the image data and to detect the data of the front edge portion of the vehicle; the data processing section 5 to measure traffic information on the basis of the front edge portion data detected; and an input/output section 6 for outputting the traffic information and for receiving a brightness/darkness signal of the illuminating apparatus in the tunnel and, further, for generating a diaphragm adjustment signal to the video camera.

Figure 2:
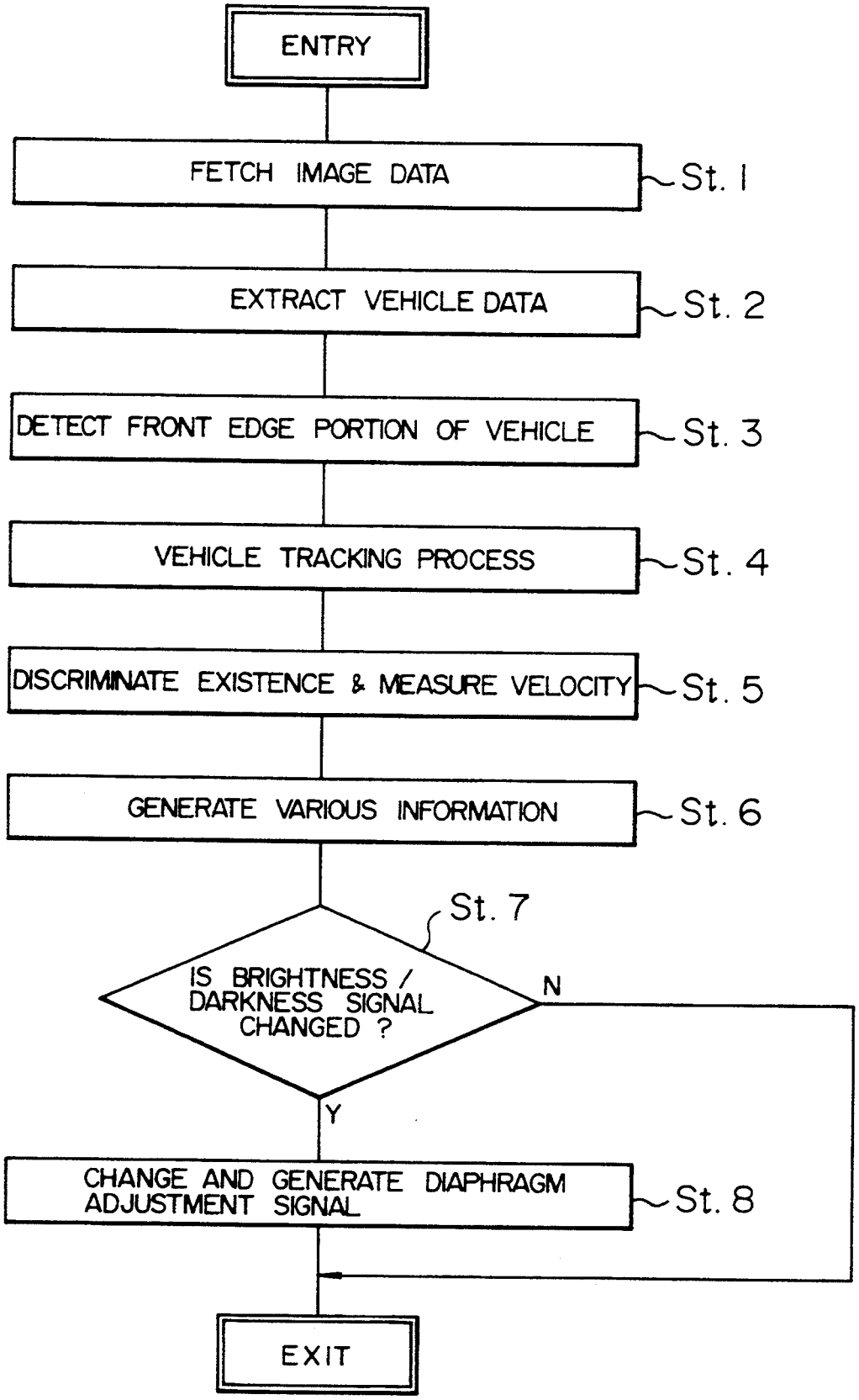
FIG. 2 is a flowchart for explaining the operation of the apparatus of the first embodiment.

The operation of the apparatus of the first embodiment will now be described on the basis of a flowchart shown in FIG. 2.

The video analog signal of the image which has been photographed by the video camera 1 is sent to the A/D converting section 2 and is converted into the digital data. The digital data is transferred to the image memory 3. The digital data of one frame of the image which has been photographed every predetermined time interval is stored in the image memory 3.

Step 1: The image processing section 4 fetches the digital data stored in the image memory 3 and the background data.

Step 2: A process to extract data of the vehicle from the difference between the digital data and the background data is executed.

Step 3: Further, the front edge portion of the extracted vehicle data is detected and stored. The front edge portion data detected is transferred to the data processing section 5.

Step 4: The data processing section 5 compares the previous front edge portion data and the present front edge portion data, thereby performing a vehicle tracking operation.

Step 5: Further, with respect to a running vehicle the tracking operation of which has been finished, the existence as a vehicle which has passed is discriminated and its velocity, kind of vehicle, and the like are measured.

Step 6: Various kinds of measured traffic information are generated from the input/output section 6.

Step 7: The data processing section 5 fetches the brightness/darkness signal supplied to the input/output section 6 and discriminates the presence or absence of a change in such a signal.

Step 8: When there is a change in brightness/darkness signal, the data processing section 5 changes a diaphragm adjustment signal which has been generated from the input/output section 6 to the video camera 1, thereby adjusting the diaphragm of the video camera 1 to a proper amount.

According to the apparatus of the first embodiment as mentioned above, even when the brightness in the tunnel is changed, the diaphragm of the video camera 1 is adjusted, thereby preventing the occurrence of a change in the video analog signal which is transferred from the video camera 1 to the A/D converting section 2. Consequently, there is no fear of occurrence of an error in the detecting step of the front edge portion data.

Second embodiment

In the apparatus of the second embodiment, a conversion level from the analog signal to the digital signal in the A/D converting section 2 is adjusted in accordance with the brightness/darkness signal to change the brightness of the illuminating apparatus in the tunnel.

Figure 3:
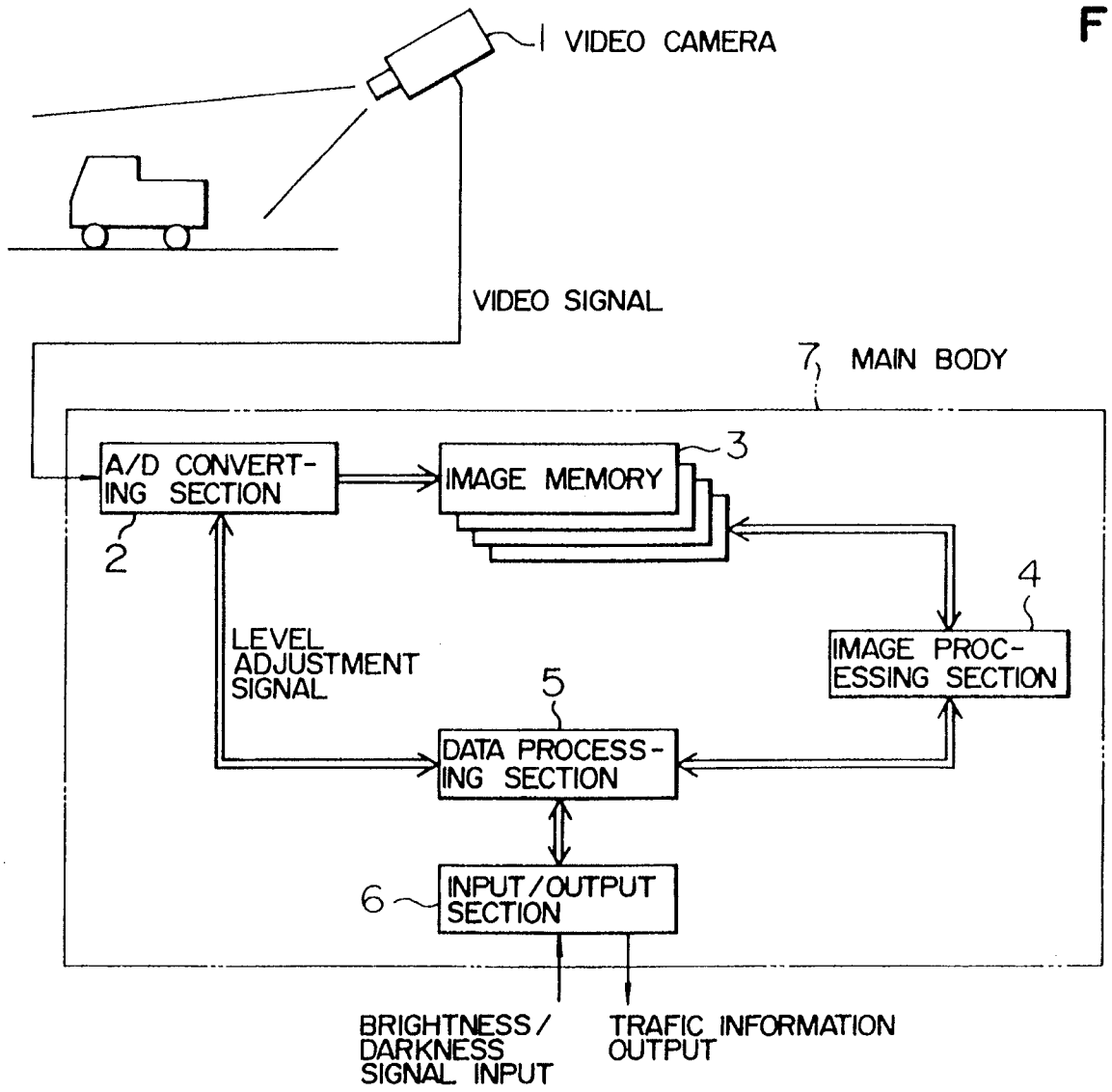
FIG. 3 is a block diagram of an apparatus for measuring a moving state of a vehicle in a tunnel according to the second embodiment.

As shown in FIG. 3, the apparatus of the second embodiment differs from the apparatus of the first embodiment shown in FIG. 1 with respect to a point that in place of the diaphragm adjustment signal which is sent from the input/output section 6 to the video camera 1, the level adjustment signal is sent from the data processing section 5 to the A/D converting section 2.

Figure 4:
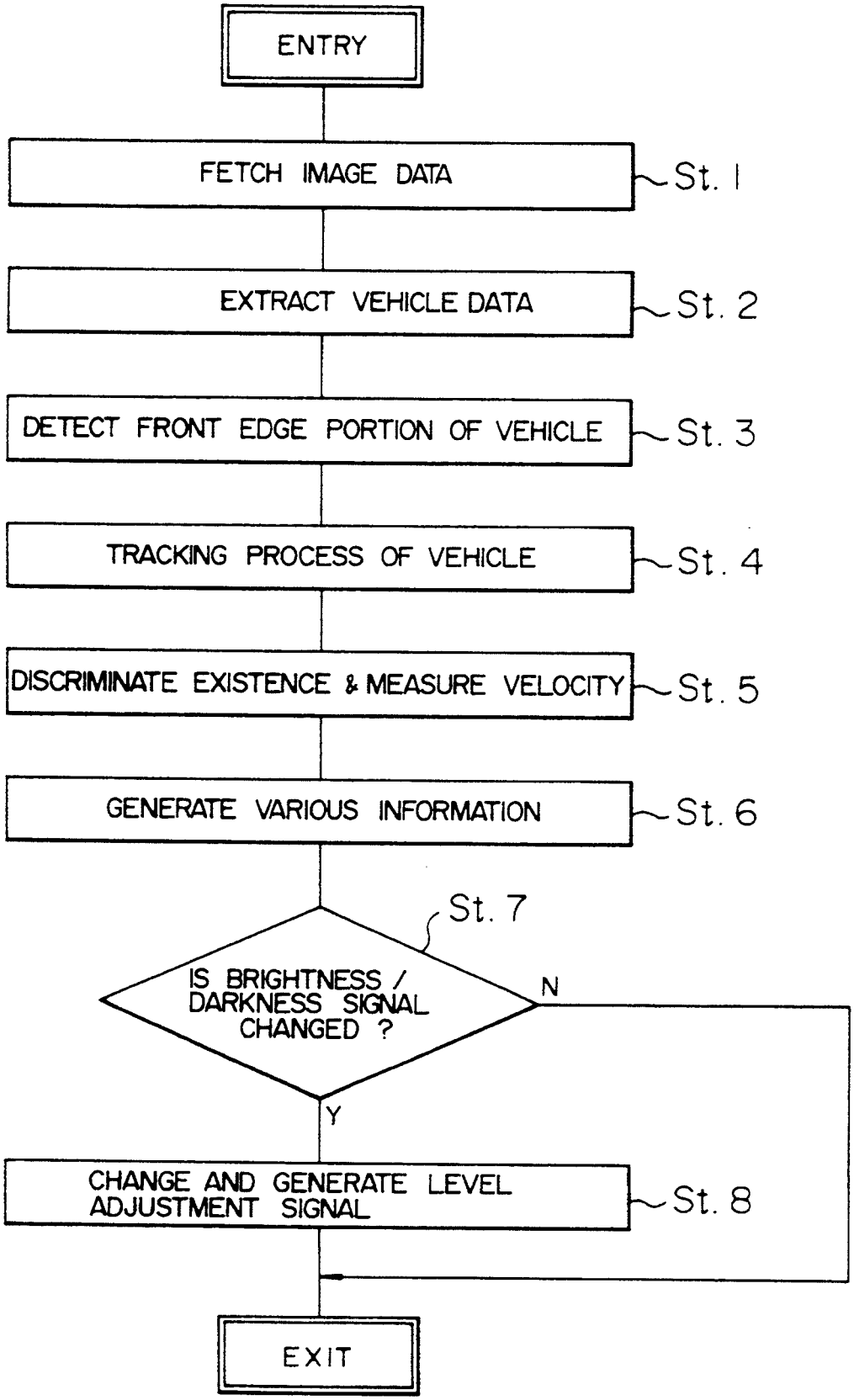
FIG. 4 is a flowchart for explaining the operation of the apparatus of the second embodiment.

The operation of the apparatus of the second embodiment will now be described on the basis of a flowchart shown in FIG. 4.

The video analog signal of the image photographed by the video camera 1 is sent to the A/D converting section 2 and converted into digital data. The digital data is transferred to the image memory 3. The digital data of one frame of the image photographed every predetermined time interval is stored into the image memory 3.

Step 1: The image processing section 4 fetches the digital data stored in the image memory 3 and the background data.

Step 2: A process to extract data of the vehicle from the difference between the digital data and the background data is executed.

Step 3: Further, the front edge portion of the extracted vehicle data is detected and stored. The detected front edge portion data is transferred to the data processing section 5.

Step 4: The data processing section 5 compares the previous front edge portion data and the present front edge portion data, thereby performing a tracking process of the vehicle.

Step 5: Further, with respect to a running vehicle whose tracking process has been finished, the existence as a vehicle which has passed is discriminated and its velocity, kind of vehicle, and the like are measured.

Step 6: Various kinds of measured traffic information are generated from the input/output section 6.

Step 7: The data processing section 5 fetches the brightness/darkness signal supplied to the input/output section 6 and discriminates the presence or absence of a change in such a signal.

Step 8: When there is a change in brightness/darkness signal, a level adjustment signal is generated from the data processing section 5 to the A/D converting section 2, thereby adjusting the conversion level from the analog signal to the digital signal in the A/D converting section 2.

According to the apparatus of the second embodiment as mentioned above, even when the brightness in the tunnel is changed, by adjusting the conversion level of the A/D converting section 2, the occurrence of a change in digital data which is formed in the A/D converting section 2 is prevented. Consequently, there is no fear of occurrence of an error in the detecting step of the front edge portion data.

Third embodiment

According to the apparatus of the third embodiment, a threshold value which is used in the image process is adjusted to a proper value in accordance with the brightness/darkness signal to change the brightness of the illuminating apparatus in the tunnel.

Figure 5:
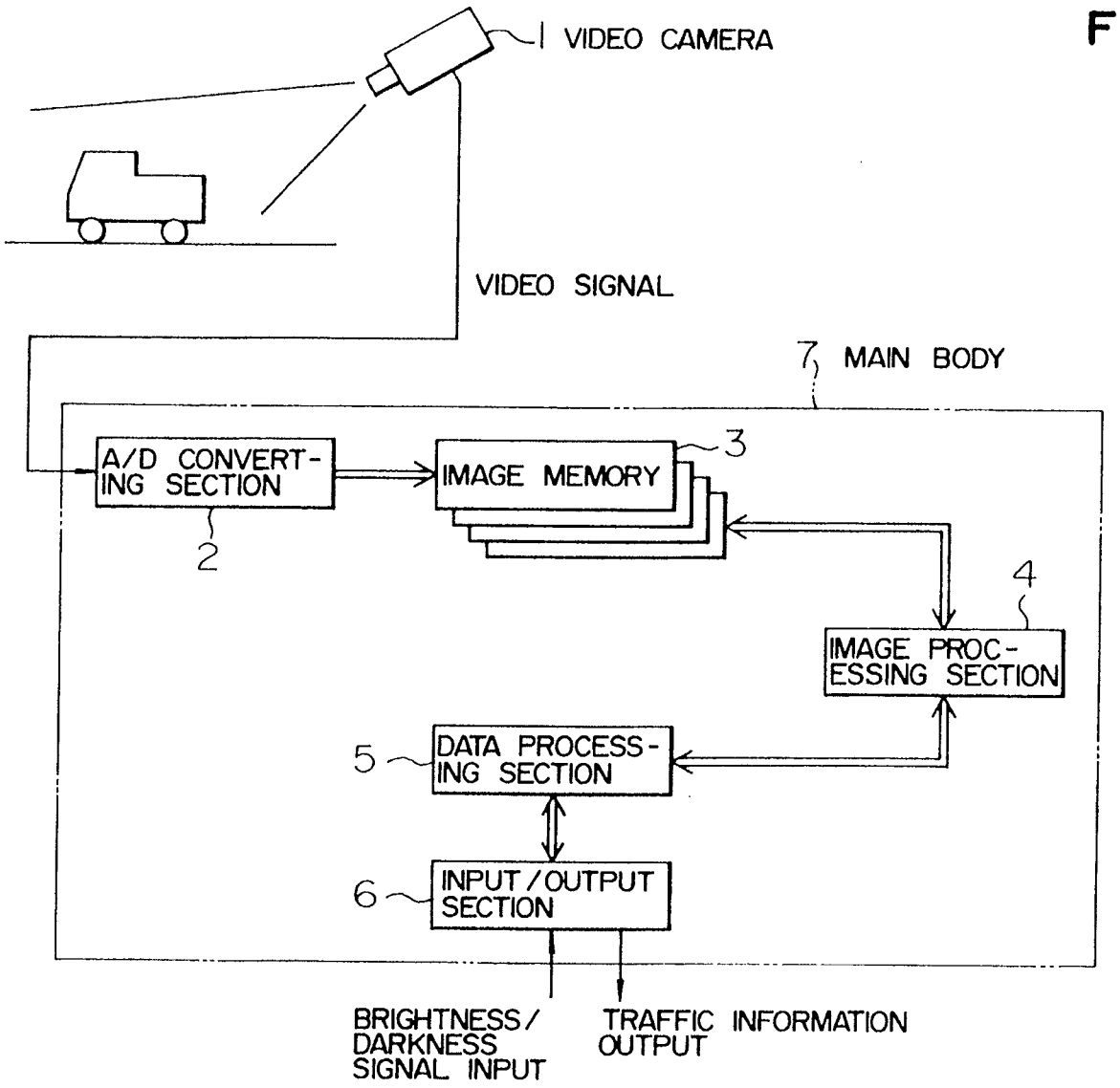
FIG. 5 is a block diagram of an apparatus for measuring a moving state of a vehicle in a tunnel according to the third embodiment.

As shown in FIG. 5, the apparatus of the third embodiment differs from the apparatus of the second embodiment shown in FIG. 3 with respect to a point that in place of the level adjustment signal which is sent from the data processing section 5 to the A/D converting section 2, a command to adjust the threshold value is sent from the data processing section 5 to the image processing section 4.

Figure 6:
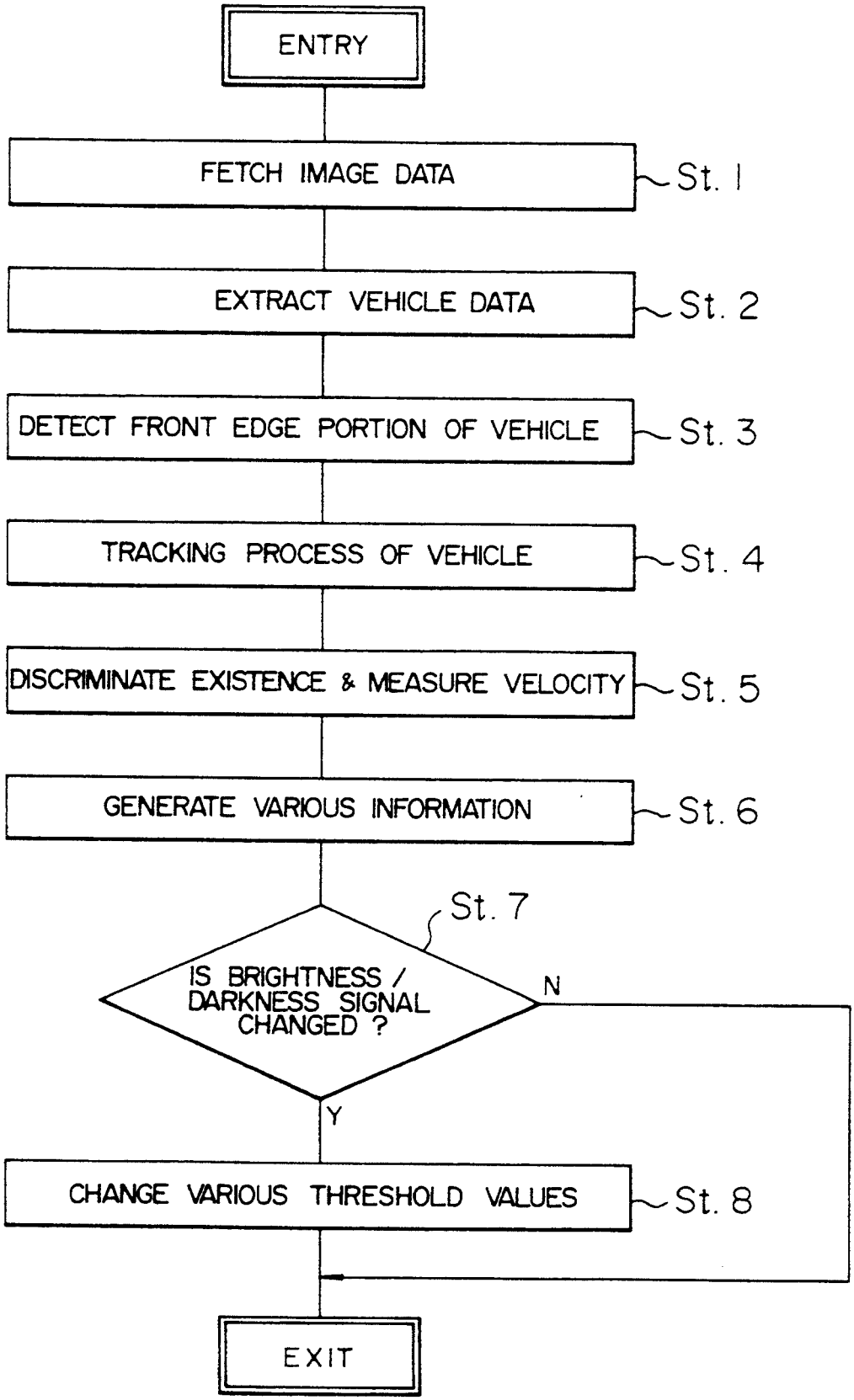
FIG. 6 is a flowchart for explaining the operation of the apparatus of the third embodiment.

The operation of the apparatus of the third embodiment will now be described on the basis of a flowchart shown in FIG. 6.

The video analog signal of the image photographed by the video camera 1 is sent to the A/D converting section 2 and converted into digital data. The digital data is transferred to the image memory 3. The digital data of one frame of the image photographed every predetermined time interval is stored into the image memory 3.

Step 1: The image processing section 4 fetches the digital data stored in the image memory 3 and the background data.

Step 2: A process to extract data of the vehicle data from the difference between the digital data and the background data is executed.

Step 3: Further, the data exceeding a predetermined threshold value is taken out from the extracted vehicle data, thereby detecting the front edge portion of the vehicle. The detected front edge portion data is sent to the data processing section 5.

Step 4: The data processing section 5 compares the previous front edge portion data and the present front edge portion data, thereby executing a tracking process of the vehicle.

Step 5: Further, with respect to the running vehicle whose tracking process has been finished, the existence as a vehicle which has passed is discriminated and its velocity, kind of vehicle, and the like are measured.

Step 6: Various kinds of measured traffic information are generated from the input/output section 6.

Step 7: The data processing section 5 fetches the brightness/darkness signal supplied to the input/output section 6 and discriminates the presence or absence of a change in brightness/darkness signal.

Step 8: When there is a change in brightness/darkness signal, a signal is sent from the data processing section 5 to the image processing section 4, thereby adjusting the threshold value which is used in the image process to a proper value.

According to the apparatus of the third embodiment as mentioned above, even when the brightness in the tunnel changes, the threshold value in the image processing section 4 is adjusted, thereby preventing the occurrence of a change in front edge portion data detected.

Fourth embodiment

According to the apparatus of the fourth embodiment, the background data which is used in the differential process in the image processing section 4 is changed in accordance with the brightness/darkness signal to change the brightness of the illuminating apparatus in the tunnel.

Figure 7:
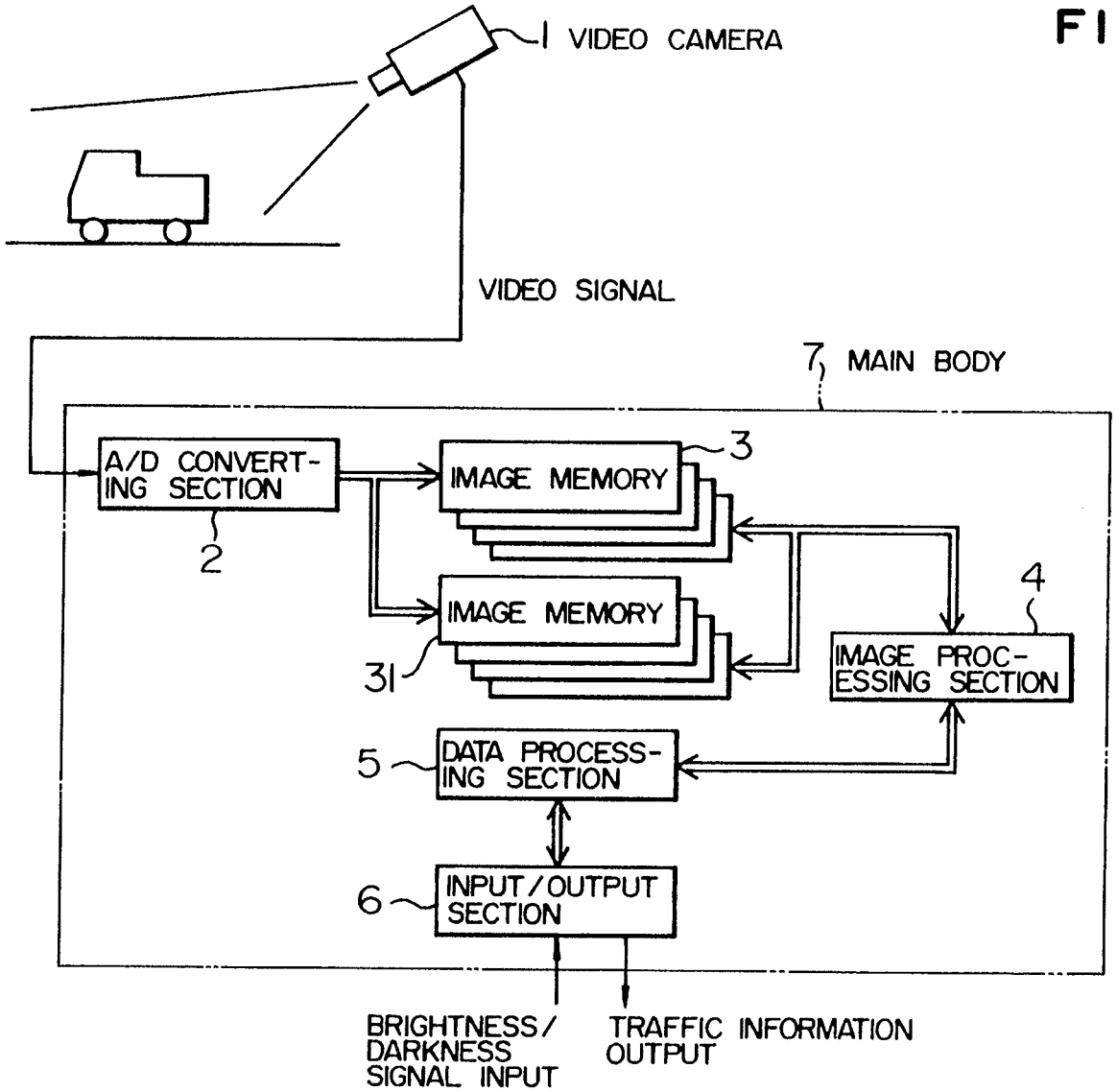
FIG. 7 is a block diagram of an apparatus for measuring a moving state of a vehicle in a tunnel according to the fourth embodiment.

As shown in FIG. 7, the apparatus of the fourth embodiment differs from the apparatus of the third embodiment shown in FIG. 5 with respect to a point that a plurality of background data corresponding to the brightnesses in the tunnel under the brightness/darkness signals are stored in image memories 3 and 31.

Figure 8:
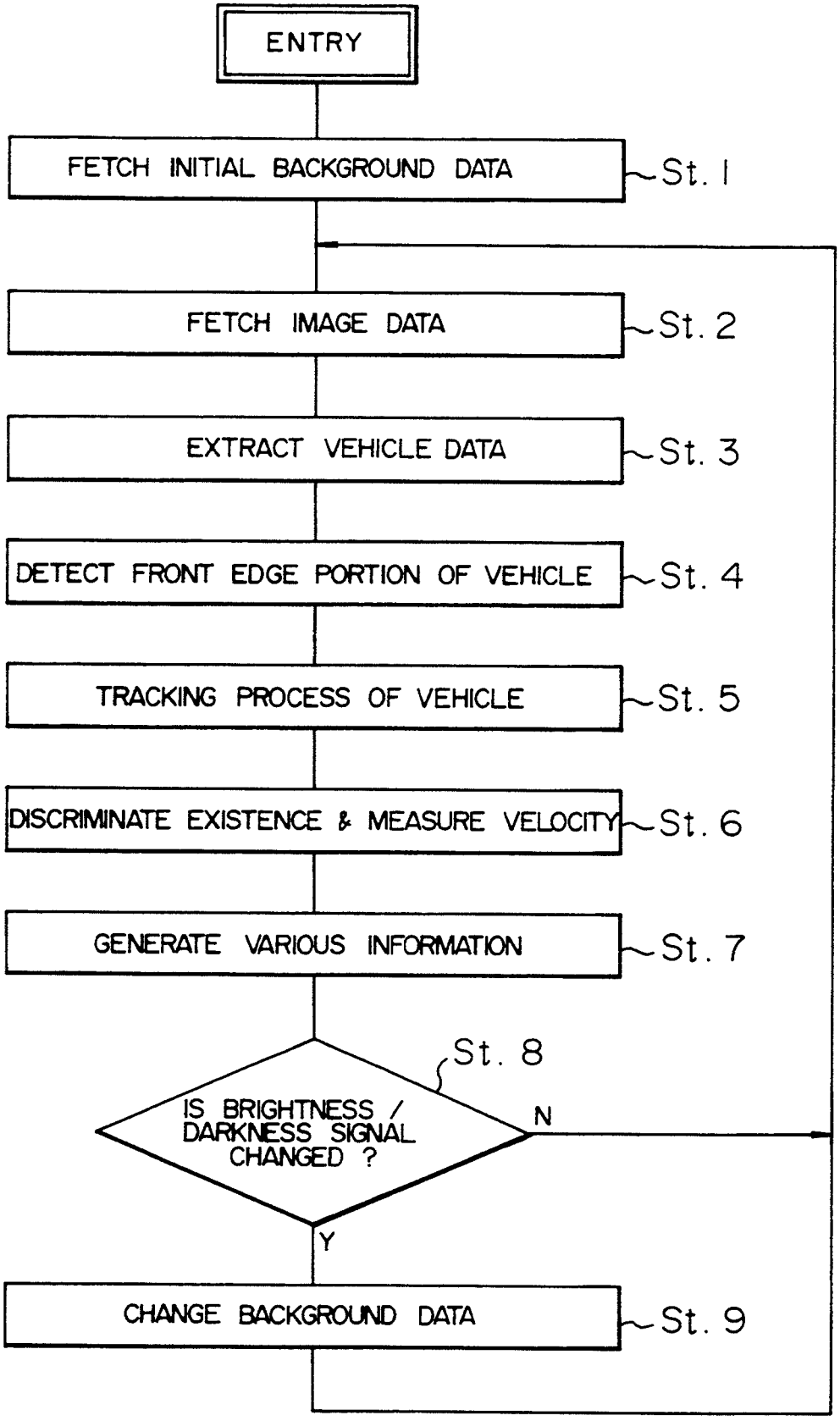
FIG. 8 is a flowchart for explaining the operation of the apparatus of the fourth embodiment.
Figure 9A:
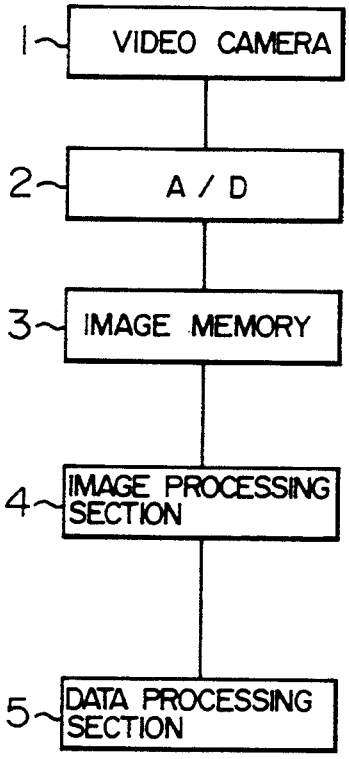
FIG. 9A PRIOR ART
FIGS. 9A and 9B are diagrams for explaining a general measuring procedure of the measuring apparatus of the moving state of the vehicle in the tunnel.
Figure 9B:
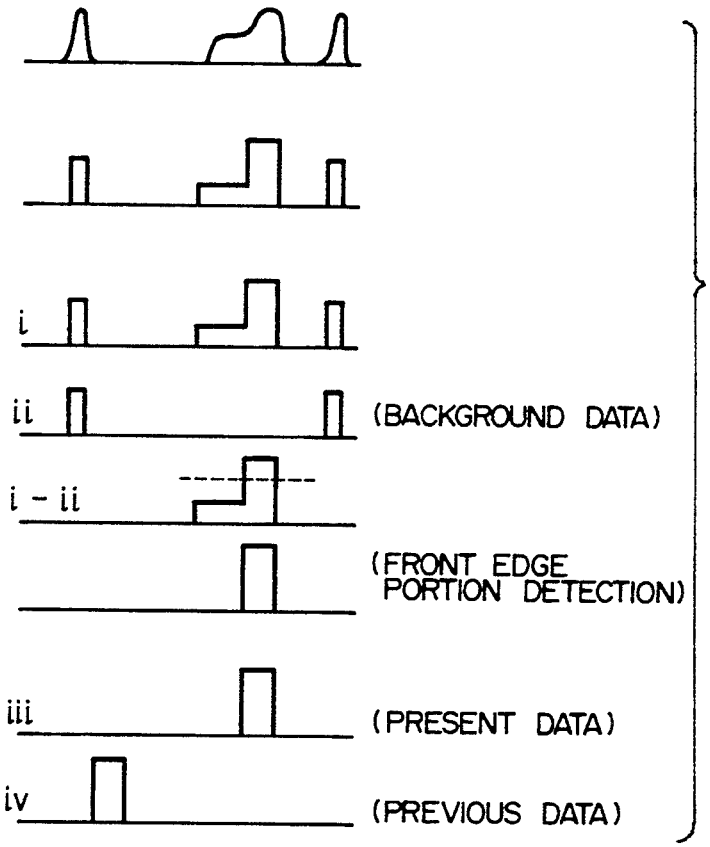
FIG. 9B PRIOR ART

The operation of the apparatus of the fourth embodiment will now be described on the basis of a flowchart shown in FIG. 8.

The video analog signal of the image photographed by the video camera 1 is sent to the A/D converting section 2 and converted into digital data. The digital data is transferred to the image memory 3. The digital data of one frame of the image photographed every predetermined time interval is stored into the image memory 3.

Step 1: The image processing section 4 fetches the background data corresponding to the brightness in the tunnel stored in the image memory 31.

Step 2: Further, the digital data of the image stored in the image memory 3 is fetched.

Step 3: A process to extract the vehicle data from the difference between the digital data and the background data is executed.

Step 4: Further, the front edge portion of the vehicle extracted is detected. The detected front edge portion data is sent to the data processing section 5.

Step 5: The data processing section 5 compares the previous front edge portion data and the present front edge portion data, thereby executing a tracking process of the vehicle.

Step 6: Further, with respect to a running vehicle whose tracking process has been finished, the existence as a vehicle which has passed is discriminated and its velocity, kind of vehicle, and the like are measured.

Step 7: Various kinds of measured traffic information are generated from the input/output section 6.

Step 8: The data processing section 5 fetches the brightness/darkness signal supplied to the input/output section 6 and discriminates the presence or absence of a change in brightness/darkness signal.

Step 9: When there is a change in brightness/darkness signal, the background data which is supplied from the image memory 31 to the image processing section 4 is changed to the background data according to the brightness/darkness signal.

According to the apparatus of the fourth embodiment as mentioned above, even when the brightness in the tunnel is changed, the background data which is used in the differential process is adjusted in accordance with the brightness in the tunnel, thereby preventing the occurrence of a change in vehicle data extracted.

Consequently, there is no fear of occurrence of an error in the detecting step of the front edge portion data.

As will be obviously understood from the description of the embodiments mentioned above, according to the measuring apparatuses of the moving state of the vehicle in the tunnel of the invention, even when the brightness in the tunnel is changed, the measurement of the traffic information can be stably continued.

I claim:

1. An apparatus for measuring a moving state of a vehicle in a tunnel, the tunnel having an illumination light source installed therein, illumination brightness of the illumination light source being adjusted by an externally applied brightness/darkness adjustment signal, said apparatus comprising:

image pickup means, installed in the tunnel, for generating image data of the vehicle;

image processing means for processing the image data to determine a state of the vehicle;

input means for receiving said externally applied brightness/darkness adjustment signal; and adjusting means for adjusting data generating operation of said image pickup means or data processing operation of said image processing means in dependence upon said brightness/darkness adjustment signal.

2. An apparatus according to claim 1, wherein said adjusting means is adapted for adjusting a diaphragm of said image pickup means.

3. An apparatus according to claim 1, wherein said adjusting means is adapted for adjusting a conversion level of an analog/digital converting section included in said image processing means.

4. An apparatus according to claim 1, wherein said adjusting means is adapted for adjusting a threshold value of said image processing means.

5. An apparatus for measuring a moving state of a vehicle in a tunnel, the tunnel having an illumination light source installed therein, illumination brightness of the illumination light source being adjusted by an externally applied brightness/darkness adjustment signal, said apparatus comprising:

image pickup means, installed in the tunnel, for generating image data of the vehicle;

image processing means for processing the image data to determine a state of the vehicle, said image processing means comprising memory means for storing a plurality of background data sets of said tunnel in accordance with various possible brightness/darkness adjustment signals;

input means for receiving said externally applied brightness/darkness adjustment signal; and adjusting means for adjusting data generating operation of said image pickup means or data processing operation of said image processing means in dependence upon said brightness/darkness adjustment signal, said adjustment means selecting one of the stored data sets in accordance with said brightness/darkness adjustment signal received by said input means.

6. An apparatus according to claim 5, wherein:

said memory means includes first memory means for storing each frame of image data generated by said image pickup means and second memory means for storing said sets of background data; and said image processing means further comprises:

data processing means for evaluating the brightness/-darkness adjustment signal received by said input means and enabling selection by said adjusting means of one of the background data sets stored in said second memory means, and means for producing difference data of (a) image data stored in said first memory means and (b) the one of the background data sets selected by said adjusting means to thereby extract possible vehicle data and measure a moving state of the vehicle.

* * * * *